US011077687B2

(12) United States Patent
Nishioka et al.

(10) Patent No.: US 11,077,687 B2
(45) Date of Patent: Aug. 3, 2021

(54) INKJET PRINTING APPARATUS AND INKJET PRINTING METHOD

(71) Applicant: CANON KABUSHIKI KAISHA, Tokyo (JP)

(72) Inventors: Shingo Nishioka, Yokohama (JP); Sae Mogi, Yokohama (JP); Satoshi Azuma, Tokyo (JP); Kazuhiko Sato, Tokyo (JP); Shin Genta, Yokohama (JP); Mitsutoshi Nagamura, Tokyo (JP); Masataka Kato, Yokohama (JP); Yoshinori Nakajima, Yokohama (JP); Kazuo Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/823,875

(22) Filed: Mar. 19, 2020

(65) Prior Publication Data

US 2020/0307283 A1 Oct. 1, 2020

(30) Foreign Application Priority Data

Mar. 27, 2019 (JP) ..... JP2019-060574

(51) Int. Cl.

| | |
|---|---|
| ***B41J 2/245*** | (2006.01) |
| ***B41J 2/21*** | (2006.01) |
| ***B41J 25/00*** | (2006.01) |

(52) U.S. Cl.

CPC ..... *B41J 25/006* (2013.01)

(58) Field of Classification Search

CPC ..... B41J 2/16585; B41J 2/155; B41J 2/2146; B41J 2/245; B41J 2/515; B41J 15/00; B41J 29/393

See application file for complete search history.

(56) References Cited

U.S. PATENT DOCUMENTS

| | | | |
|---|---|---|---|
| 5,311,214 | A | 5/1994 | Hirasawa et al. |
| 5,739,828 | A | 4/1998 | Moriyama et al. |
| 6,089,697 | A | 7/2000 | Tajika et al. |
| 6,099,116 | A | 8/2000 | Fujita et al. |
| 6,120,141 | A | 9/2000 | Tajika et al. |
| 6,158,834 | A | 12/2000 | Kato et al. |
| 6,206,502 | B1 | 3/2001 | Kato et al. |

(Continued)

FOREIGN PATENT DOCUMENTS

| | | | |
|---|---|---|---|
| JP | 2006-096022 | A | 4/2006 |
| JP | 4715209 | B2 | 7/2011 |

*Primary Examiner* — Jason S Uhlenhake

(74) *Attorney, Agent, or Firm* — Venable LLP

(57) ABSTRACT

Images with high image quality having less time-difference unevenness are outputted in an inkjet printing apparatus that performs multi-pass printing using full-line inkjet print heads 2. For this purpose, a CPU is capable of setting a first printing method in which an image for a unit area is printed by a specified number of printing conveyance operations and a second printing method in which an image for a unit area is printed by a smaller number than the specified number of printing conveyance operations. The CPU sets conveyance conditions such that a taken time for one printing conveyance operation of the printing conveyance operations for a unit area in the second printing method is smaller than a taken time for one successive printing conveyance operation of the printing conveyance operations for a unit area in the first printing method.

12 Claims, 13 Drawing Sheets

(56) References Cited

U.S. PATENT DOCUMENTS 6,234,606 B1 5/2001 Suzuki
6,264,320 B1 7/2001 Moriyama et al.
6,309,051 B1 10/2001 Koitabashi et al.
6,325,492 B1 12/2001 Koitabashi et al.
6,390,583 B1 5/2002 Kato et al.
6,412,934 B1 7/2002 Moriyama et al.
6,435,639 B1 8/2002 Nakajima et al.
6,450,606 B1 9/2002 Kato et al.
6,467,866 B1 10/2002 Nagoshi et al.
6,474,768 B1 11/2002 Yano et al.
6,494,557 B1 12/2002 Kato et al.
6,505,909 B1 1/2003 Kato et al.
6,572,216 B1 6/2003 Koitabashi et al.
6,585,353 B1 7/2003 Kanematsu et al.
6,612,678 B2 9/2003 Kato et al.
6,652,053 B2 11/2003 Imanaka et al.
6,834,947 B2 12/2004 Moriyama et al.
6,918,656 B2 7/2005 Koitabashi et al.
6,966,629 B2 11/2005 Nakajima et al.
6,991,327 B2 1/2006 Goto et al.
7,097,267 B2 8/2006 Kato et al.
7,144,093 B2 12/2006 Nakajima et al.
7,281,780 B2 10/2007 Nagamura et al.
7,347,519 B2 3/2008 Nagamura et al.
7,367,643 B2 5/2008 Furuichi et al.
7,396,098 B2 7/2008 Kanematsu et al.
7,425,056 B1 9/2008 Koitabashi et al.
7,445,313 B2 11/2008 Tsutsumi et al.
7,460,271 B2 12/2008 Kanematsu et al.
7,517,044 B2 4/2009 Suzuki et al.
7,556,343 B2 7/2009 Kato et al.
7,762,640 B2 7/2010 Kanda et al.
7,775,622 B2 8/2010 Suzuki et al.
7,789,476 B2 9/2010 Tomida et al.
7,891,754 B2 2/2011 Nagamura et al.
7,980,652 B2 7/2011 Baba et al.
8,057,009 B2 11/2011 Tomida et al.
8,388,090 B2 3/2013 Nakajima et al.
8,444,246 B2 5/2013 Muro et al.
8,517,490 B2 8/2013 Kanematsu et al.
8,608,277 B2 12/2013 Tomida et al.
8,622,501 B2 1/2014 Komamiya et al.
8,628,163 B2 1/2014 Kanematsu et al.
8,630,017 B2 1/2014 Kanematsu et al.
8,636,334 B2 1/2014 Nishioka et al.
8,675,250 B2 3/2014 Muro et al.
8,702,192 B2 4/2014 Danzuka et al.
8,721,021 B2 5/2014 Nakajima et al.
8,727,477 B2 5/2014 Kosaka et al.
8,757,754 B2 6/2014 Azuma et al.
8,845,060 B2 9/2014 Azuma et al.
8,950,843 B2 2/2015 Oikawa et al.
9,028,029 B2 5/2015 Azuma et al.
9,028,049 B2 5/2015 Azuma et al.
9,039,112 B2 5/2015 Murayama et al.
9,039,120 B2 5/2015 Nishioka
9,079,421 B2 7/2015 Kato et al.
9,108,409 B2 8/2015 Suzuki et al.
9,114,607 B2 8/2015 Ishii et al.
9,211,748 B2 12/2015 Baba et al.
9,340,009 B2 5/2016 Murayama et al.
9,434,196 B2 9/2016 Fukasawa et al.
2002/0021323 A1* 2/2002 Kanazawa ..... B41J 3/28 347/41
2006/0044331 A1* 3/2006 Tsutsumi ..... B41J 29/393 347/5
2006/0238595 A1* 10/2006 Park ..... B41J 2/2146 347/104
2009/0021548 A1 1/2009 Suzuki et al.
2009/0079777 A1 3/2009 Nagamura et al.
2012/0033006 A1 2/2012 Murayama et al.
2012/0050360 A1 3/2012 Nagamura
2012/0069067 A1 3/2012 Torigoe et al.
2019/0176467 A1 6/2019 Azuma et al.

* cited by examiner

ELAPSED TIME BETWEEN PASSES FOR EACH UNIT AREA

| | BETWEEN 1st AND 2nd PASSES | BETWEEN 2nd AND 3rd PASSES | BETWEEN 3rd AND 4th PASSES | BETWEEN 4th AND 5th PASSES | BETWEEN 5th AND 6th PASSES | BETWEEN 6th AND 7th PASSES |
|---|---|---|---|---|---|---|
| FIRST UNIT AREA | 0 | 6 | 2 | 4 | 4 | 2 |
| SECOND UNIT AREA | 2 | 4 | 4 | 2 | 6 | 0 |

FIG.7

| | BETWEEN 1st AND 2nd PASSES | BETWEEN 2nd AND 3rd PASSES | BETWEEN 3rd AND 4th PASSES | BETWEEN 4th AND 5th PASSES |
|---|---|---|---|---|
| FIRST UNIT AREA | 0 | 4 | 2 | 2 |
| SECOND UNIT AREA | 2 | 2 | 4 | 0 |

| | BETWEEN 1st AND 2nd PASSES | BETWEEN 2nd AND 3rd PASSES | BETWEEN 3rd AND 4th PASSES | BETWEEN 4th AND 5th PASSES |
|---|---|---|---|---|
| FIRST UNIT AREA | 0 | 2 | 1 | 1 |
| SECOND UNIT AREA | 1 | 1 | 2 | 0 |

DIFFERENCE IN ELAPSED TIME BETWEEN PASSES FOR ADJOINING UNIT AREAS

| | BETWEEN 1st AND 2nd PASSES | BETWEEN 2nd AND 3rd PASSES | BETWEEN 3rd AND 4th PASSES | BETWEEN 4th AND 5th PASSES |
|---|---|---|---|---|
| SECOND PRINTING METHOD | −2 | 2 | −2 | 2 |
| THIRD PRINTING METHOD | −1 | 1 | −1 | 1 |

FIG.10

| | | MULTI-PASS NUMBER | UNIT AREA WIDTH |
|---|---|---|---|
| PRINT MEDIUM A | FIRST PRINTING METHOD | 7 | 1 |
| | THIRD PRINTING METHOD | 5 | 0.5 |
| PRINT MEDIUM B | FIRST PRINTING METHOD | 7 | 1 |
| | FOURTH PRINTING METHOD | 5 | 0.8 |

FIG.11

| PRINTING METHOD | MULTI-PASS NUMBER | CONVEYANCE SPEED OF PRINT MEDIUM | DIFFERENCE IN ELAPSED TIME BETWEEN PASSES FOR ADJOINING UNIT AREAS | | | | | |
|---|---|---|---|---|---|---|---|---|
| | | | BETWEEN 1st AND 2nd PASSES | BETWEEN 2nd AND 3rd PASSES | BETWEEN 3rd AND 4th PASSES | BETWEEN 4th AND 5th PASSES | BETWEEN 5th AND 6th PASSES | BETWEEN 6th AND 7th PASSES |
| FIRST PRINTING METHOD | 7 | 1 | −2 | 2 | −2 | 2 | −2 | 2 |
| SECOND PRINTING METHOD | 5 | 1 | −2 | 2 | −2 | 2 | – | – |
| FIFTH PRINTING METHOD | 5 | 2 | −1 | 1 | −1 | 1 | – | – |

FIG.12

| | PRINTING METHOD | MULTI-PASS NUMBER | CONVEYANCE SPEED OF PRINT MEDIUM |
|---|---|---|---|
| PRINT MEDIUM A | FIRST PRINTING METHOD | 7 | 1 |
| | FIFTH PRINTING METHOD | 5 | 2 |
| PRINT MEDIUM B | FIRST PRINTING METHOD | 7 | 1 |
| | SIXTH PRINTING METHOD | 5 | 1.25 |

FIG.13

INKJET PRINTING APPARATUS AND INKJET PRINTING METHOD

BACKGROUND OF THE INVENTION

Field of the Invention

The present invention relates to inkjet printing apparatuses and inkjet printing methods.

Description of the Related Art

Japanese Patent No. 4715209 discloses a multi-pass printing method in which an image is printed on a print medium by repeating a step of conveying the print medium in the forward direction and a step of conveying the print medium in the reverse direction while inkjet print heads of a line type fixed in the apparatus are ejecting ink. Such a multi-pass printing method can prevent bleeding that would be caused by a large amount of ink applied in a short period of time because ink is applied stepwise to the same image areas of the print medium by multiple printing conveyance operations.

In addition, in a case where a step of moving print heads by a length corresponding to several pixels in the nozzle arrangement direction is provided between printing conveyance operations, a pixel raw extending in the conveyance direction on a print medium is printed by multiple different nozzles, and this reduces streaks and unevenness resulting from ejection characteristics of each nozzle.

Unfortunately, in the above multi-pass printing method, color unevenness caused by time differences in multiple timings at which ink is applied is noticeable in some cases between two unit areas on which images are printed through different series of printing conveyance operations. Hereinafter, color unevenness that occurs resulting from the above difference in ink application timing is referred to herein as time-difference unevenness.

SUMMARY OF THE INVENTION

The present invention has been made to solve the above problem. Hence, an object thereof is to output images with high image quality having less time-difference unevenness in an inkjet printing apparatus that performs multi-pass printing using full-line inkjet print heads.

In a first aspect of the present invention, there is provided an inkjet printing apparatus comprising: a print head that has multiple nozzles configured to eject ink and arrayed in a first direction; a conveying unit capable of conveying a print medium relative to the print head in a second direction intersecting the first direction and in a third direction opposite to the second direction; and a control unit configured to control the print head and the conveying unit such that an image for a unit area is printed by multiple printing conveyance operations in which a printing conveyance operation for conveying the print medium in the second direction while ejecting ink to the unit area of the print medium and a printing conveyance operation for conveying the print medium in the third direction while ejecting ink to the unit area of the print medium are repeated alternately, wherein the control unit is capable of setting a first printing method in which an image for a unit area is printed by a specified number of the printing conveyance operations and a second printing method in which an image for a unit area is printed by a smaller number than the specified number of the printing conveyance operations, and the control unit sets the first printing method and the second printing method such that a time to be taken for one printing conveyance operation of the printing conveyance operations for a unit area in the second printing method is smaller than a time to be taken for one printing conveyance operation of the printing conveyance operations for a unit area in the first printing method.

In a second aspect of the present invention, there is provided an inkjet printing method for an inkjet printing apparatus including: a print head that has multiple nozzles configured to eject ink and arrayed in a first direction; and a conveying unit capable of conveying a print medium relative to the print head in a second direction intersecting the first direction and in a third direction opposite to the second direction, wherein an image for a unit area is printed by multiple printing conveyance operations in which a printing conveyance operation for conveying the print medium in the second direction while ejecting ink to the unit area of the print medium and a printing conveyance operation for conveying the print medium in the third direction while ejecting ink to the unit area of the print medium are repeated alternately, a first printing method and a second printing method are settable; in the first printing method, an image for a unit area is printed by a specified number of the printing conveyance operations; and in the second printing method, an image for a unit area is printed by a smaller number than the specified number of the printing conveyance operations, and the first printing method and the second printing method are set such that a taken time for one printing conveyance operation of the printing conveyance operations for a unit area in the second printing method is smaller than a taken time for one printing conveyance operation of the printing conveyance operations for a unit area in the first printing method.

Further features of the present invention will become apparent from the following description of exemplary embodiments with reference to the attached drawings.

BRIEF DESCRIPTION OF THE DRAWINGS

FIG. 7 is a diagram for comparing elapsed time between passes for a first unit area and that for a second unit area;

FIG. 10 is a diagram for comparing the difference in elapsed time between a second printing method and the third printing method;

FIG. 11 is a diagram illustrating printing methods prepared in a second embodiment;

FIG. 12 is a diagram illustrating printing methods prepared in a third embodiment; and FIG. 13 is a diagram illustrating printing methods prepared in a fourth embodiment.

DESCRIPTION OF THE EMBODIMENTS

First Embodiment

Figure 1:
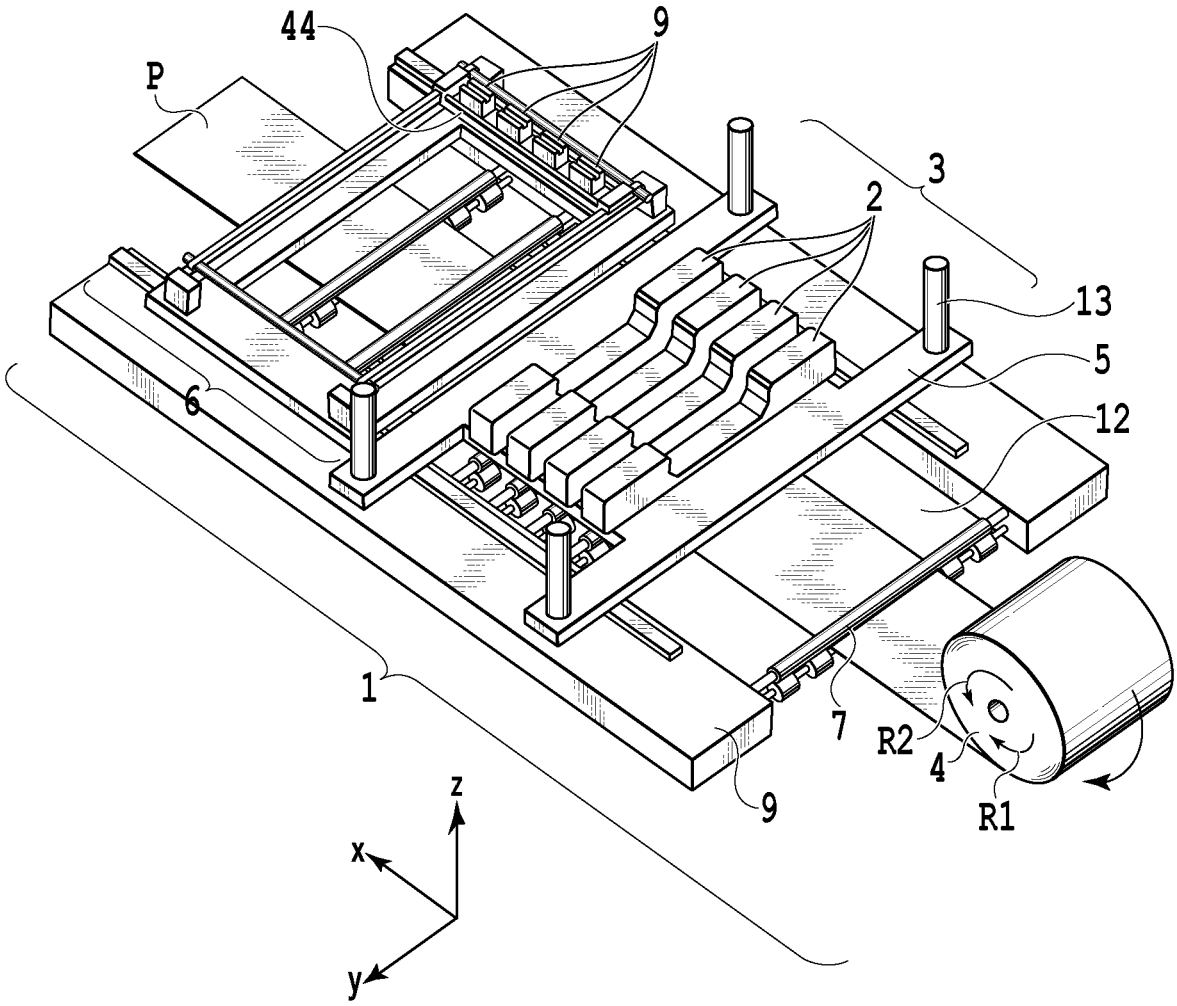
FIG. 1 is a perspective view of a main part of an inkjet printing apparatus.

FIG. 1 is a perspective view of a main part of an inkjet printing apparatus 1 (hereinafter also referred to as a "printing apparatus") that can be used in the present embodiment. In the drawings referred to in the following, the x direction indicates the substantial conveyance direction of a print medium P, the y direction intersecting the x direction indicates the width direction of the print medium P, and the z direction indicates the vertical direction.

The print medium P of the present embodiment is a long length of a print medium wound around a not-illustrated roll shaft and held as a roll 4. The roll 4 is rotatable in the R1 and R2 directions in the figure by means of a not-illustrated drive unit. Conveying roller pairs 7 each including a driving roller and a driven roller support the print medium P peeled off the roll 4 from the front and back surfaces of the print medium P and convey the print medium P in the +x direction (forward direction) or the −x direction (reverse direction) which is the opposite direction. In the present embodiment, those conveying roller pairs 7 are disposed at multiple positions in the conveyance direction (x direction) and support the print medium P.

A head unit 3 has four print heads 2 and a head holder 5 holding the print heads 2. The head holder 5 holding the four print heads 2 is movable up and down in the z direction along elevation shafts 13 by means of a not-illustrated drive unit. Each of the four print heads 2 ejects ink in a different color according to print data to print an image on a print medium P being conveyed. The inks to be ejected by the print heads 2 are supplied from ink tanks disposed within the apparatus to the print heads 2 via not-illustrated tubes. A platen 12 supports the print medium P from the back surface while keeping the smoothness of the print medium P.

In print operation, a maintenance unit 6 for performing a maintenance process for the print heads 2 is disposed downstream (on the +x direction side) of the head unit 3. The maintenance unit 6 has wiper blades 9 for wiping the nozzle surfaces of the four print heads 2 and a wiper holder 44 holding the wiper blades 9 and movable in a horizontal direction (the y direction). The maintenance unit 6 is also movable in the ±x direction in the figure by means of a not-illustrated drive unit. To perform maintenance operation, the head holder 5 moves up in the +z direction, and the maintenance unit 6 moves in the −x direction to a position immediately below the head unit 3.

Note that although not illustrated in FIG. 1, a cutter unit for cutting print media on which printing has been completed and a discharge tray for storing the cut print media are disposed at positions further downstream (on the +x direction side) of the maintenance unit 6.

Figure 2:
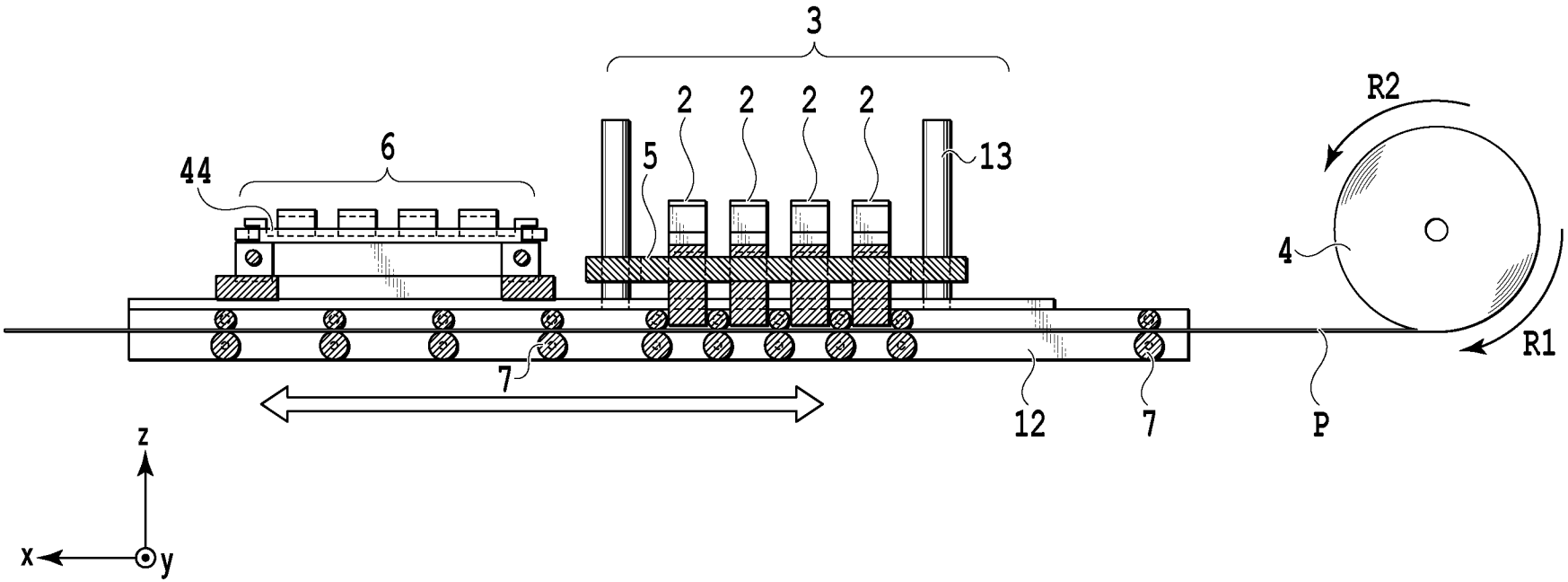
FIG. 2 is a side view of the printing apparatus performing print operation.
Figure 3:
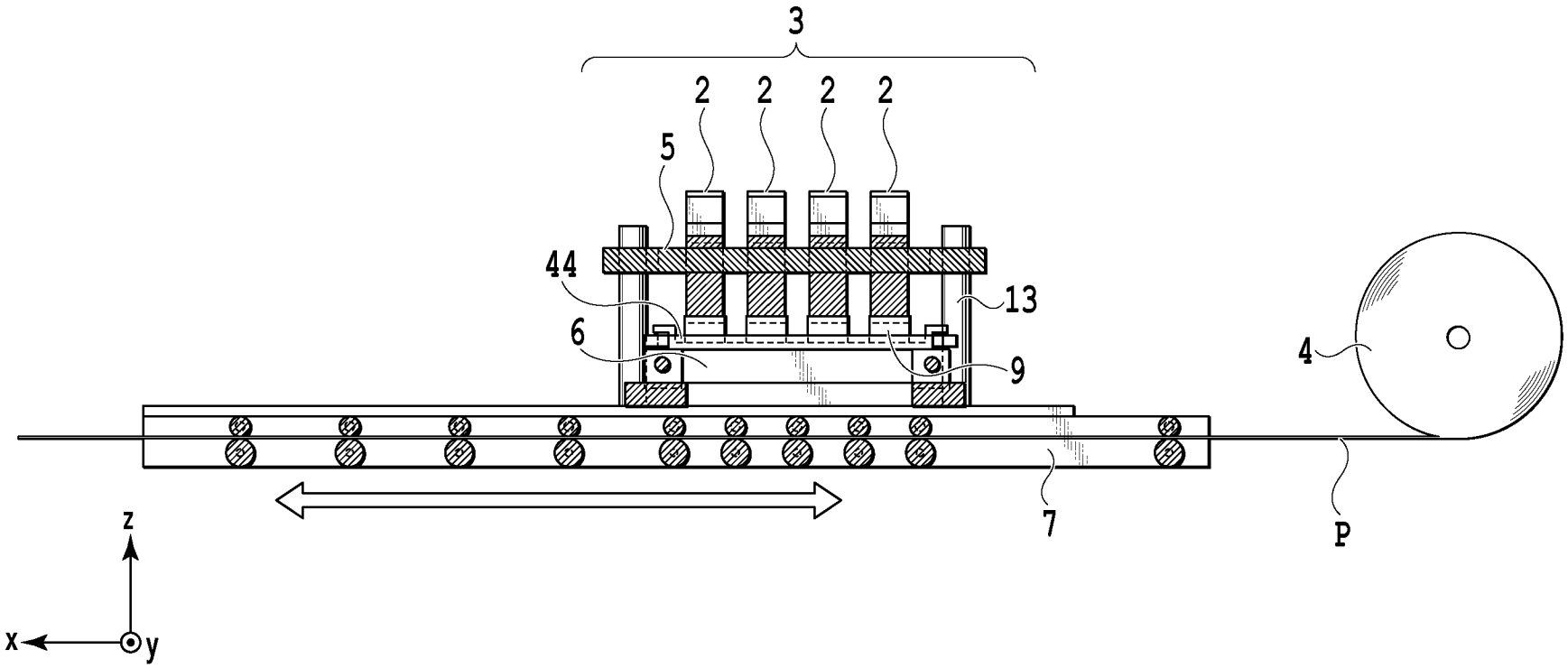
FIG. 3 is a side view of the printing apparatus performing maintenance operation.

FIGS. 2 and 3 are side view diagrams illustrating the positional relationship between the head unit 3 and the maintenance unit 6 when print operation is being performed and when maintenance operation is being performed. When the print operation is being performed, the head holder 5 is located at a relatively low position, and the nozzle surfaces of the print heads 2 are positioned close to the platen 12 as illustrated in FIG. 2. The maintenance unit 6 is located at a position downstream of the head unit 3 in the conveyance direction (a position on the +x direction side).

When the maintenance operation is being performed, the head holder 5 is moved to a relatively high position, and the maintenance unit 6 that has moved in the −x direction is located between the head holder 5 and the platen 12, as illustrated in FIG. 3. At this time, the four wiper blades 9 on the maintenance unit 6 are located at a height that enables the wiper blades 9 to touch the nozzle surfaces of the four print heads 2.

Figure 4A:
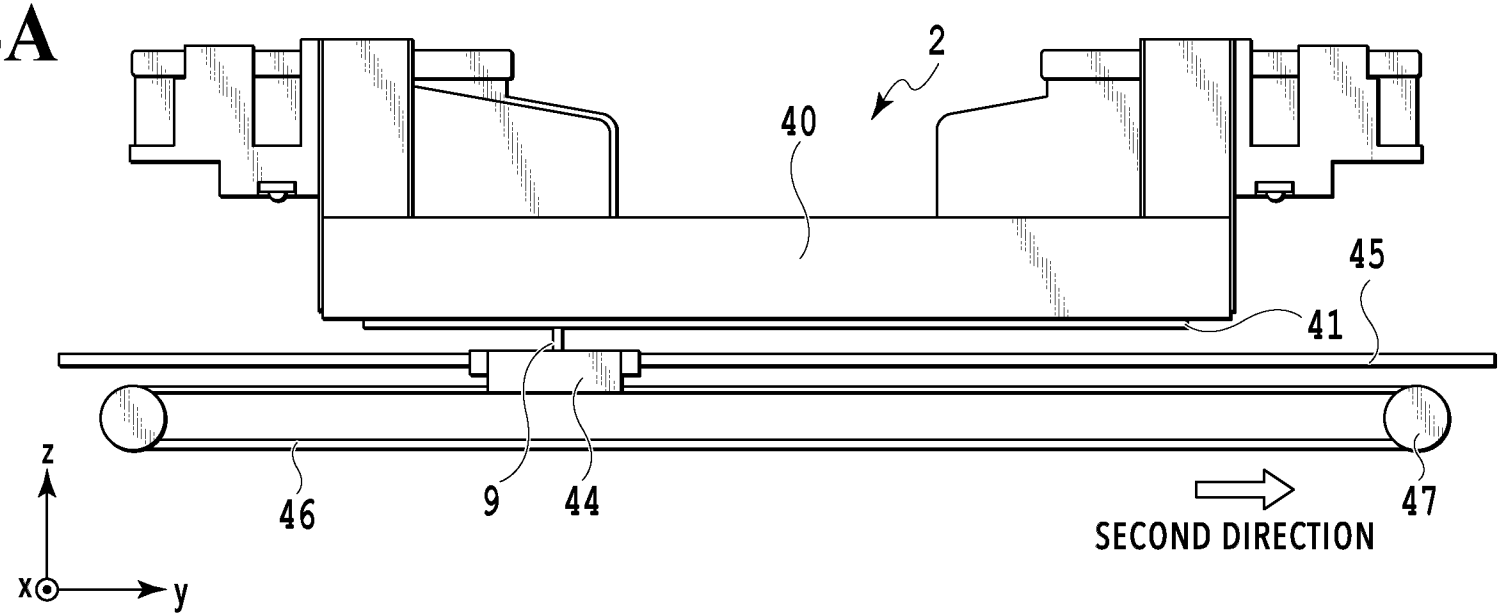
FIGS. 4A and 4B are diagrams for explaining the configuration of the print head.
Figure 4B:
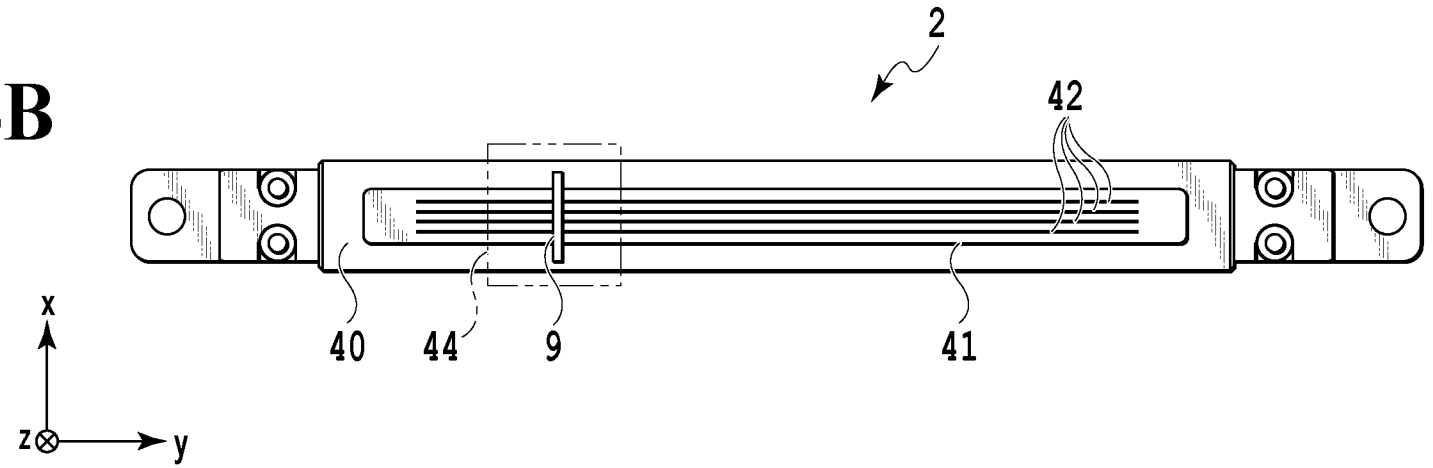

FIGS. 4A and 4B are diagrams for explaining the configuration of the print head 2. FIG. 4A is a side view of the print head 2, showing the state in which the maintenance operation is being performed for the print head. The print head 2 in the present embodiment is a full-line inkjet print head having nozzles for ejecting ink, arranged in the y direction by the length corresponding to the maximum width of the print medium P.

The wiper holder 44 is connected to a portion of a drive belt 46, and when a drive shaft 47 rotates, the wiper holder 44 moves in the ±y direction in the figure being guided by a shaft 45. When the wiper blades 9 held by the wiper holder 44 move in the ±y direction in the figure while keeping in contact with the nozzle surfaces of the print heads 2, extra ink, dust, and the like attached to the nozzle surfaces of the print heads 2 are removed.

FIG. 4B is a diagram illustrating the arrangement of nozzle rows of the print head 2. The print head 2 of the present embodiment is an example in which a long base substrate 40 is provided with a long chip 41. The long chip 41 has four parallel nozzle rows 42 each composed of nozzles configured to eject ink in the same color and lined in a row by the length corresponding to the maximum width of the print medium P. Each of the four nozzle rows ejects black, cyan, magenta, or yellow ink. The chip 41 has ejecting elements configured to generate energy for ejecting ink and associated with the respective nozzles. The ejecting elements may be electrothermal conversion elements (heaters), piezo elements, electrostatic elements, MEMS elements, or the like.

Figure 5:
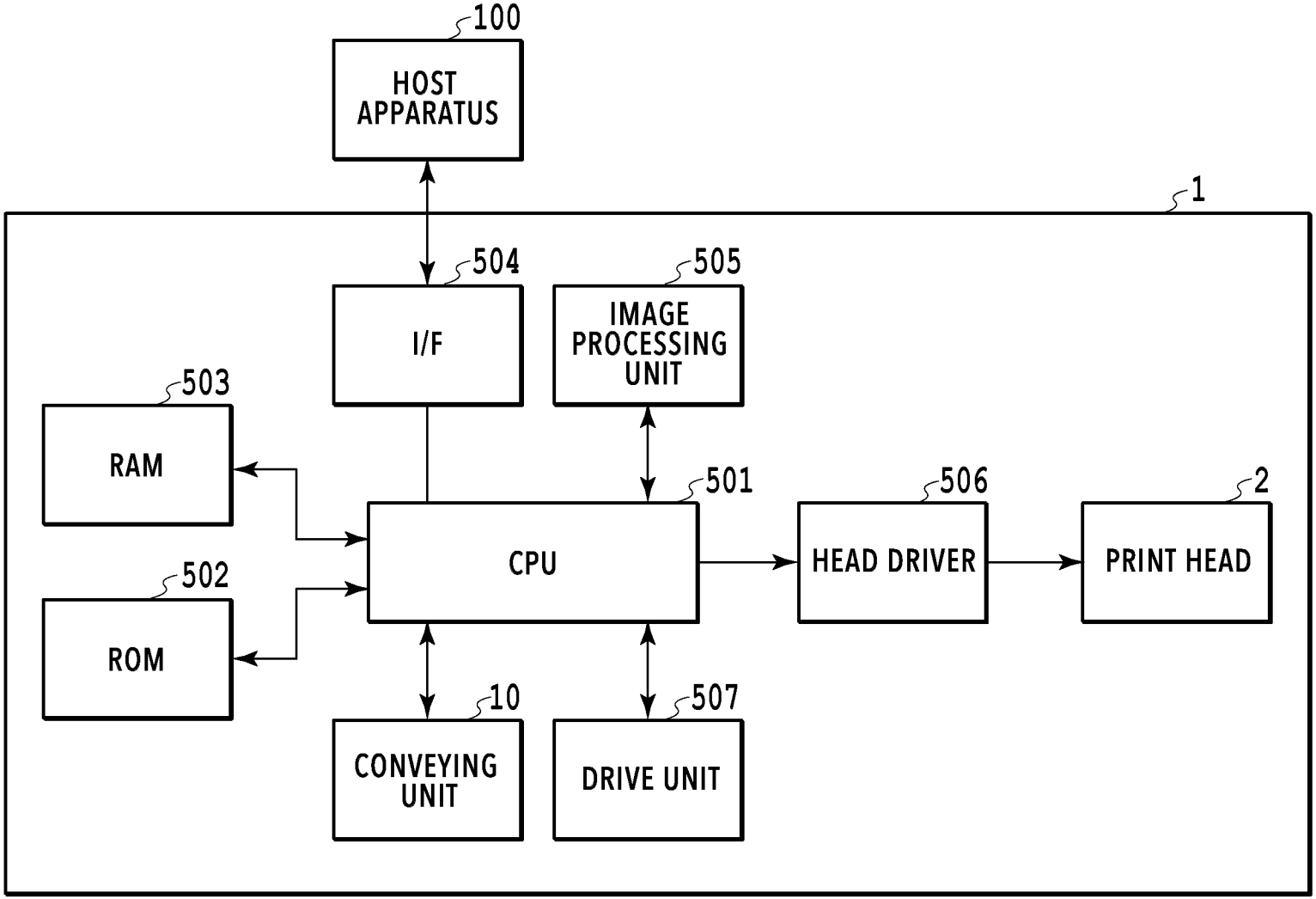
FIG. 5 is a block diagram illustrating the control configuration of the printing apparatus.

FIG. 5 is a block diagram illustrating the control configuration of the printing apparatus 1. A CPU 501 controls the entire apparatus according to programs and parameters stored in ROM 502, using RAM 503 as a work area. Image data created by a host apparatus 100 connected to the outside is inputted to the printing apparatus 1 via an interface I/F 504 and loaded into the RAM 503 based on instructions from the CPU 501. An image processing unit 505 performs specified image processing on the image data loaded into the RAM 503 based on instructions from the CPU 501 and generates print data that can be printed by the print heads 2.

A head driver 506 drives the print heads 2 to eject ink according to the generated print data based on instructions from the CPU 501. During the ejecting operation by the print heads 2, a conveying unit 10 conveys the print medium P. Here, the conveying unit 10, including the multiple conveying roller pairs 7, the roll 4, and the drive units for these parts explained with reference to FIG. 1, conveys the print medium P in the forward or reverse direction according to the conveyance length and the conveyance direction or the conveyance speed indicated by the CPU 501.

A drive unit 507 controls the movement of the head holder 5, the maintenance unit 6, and the wiper holder 44 based on instructions from the CPU 501 in conjunction with the print operation and the maintenance operation.

Figure 6:
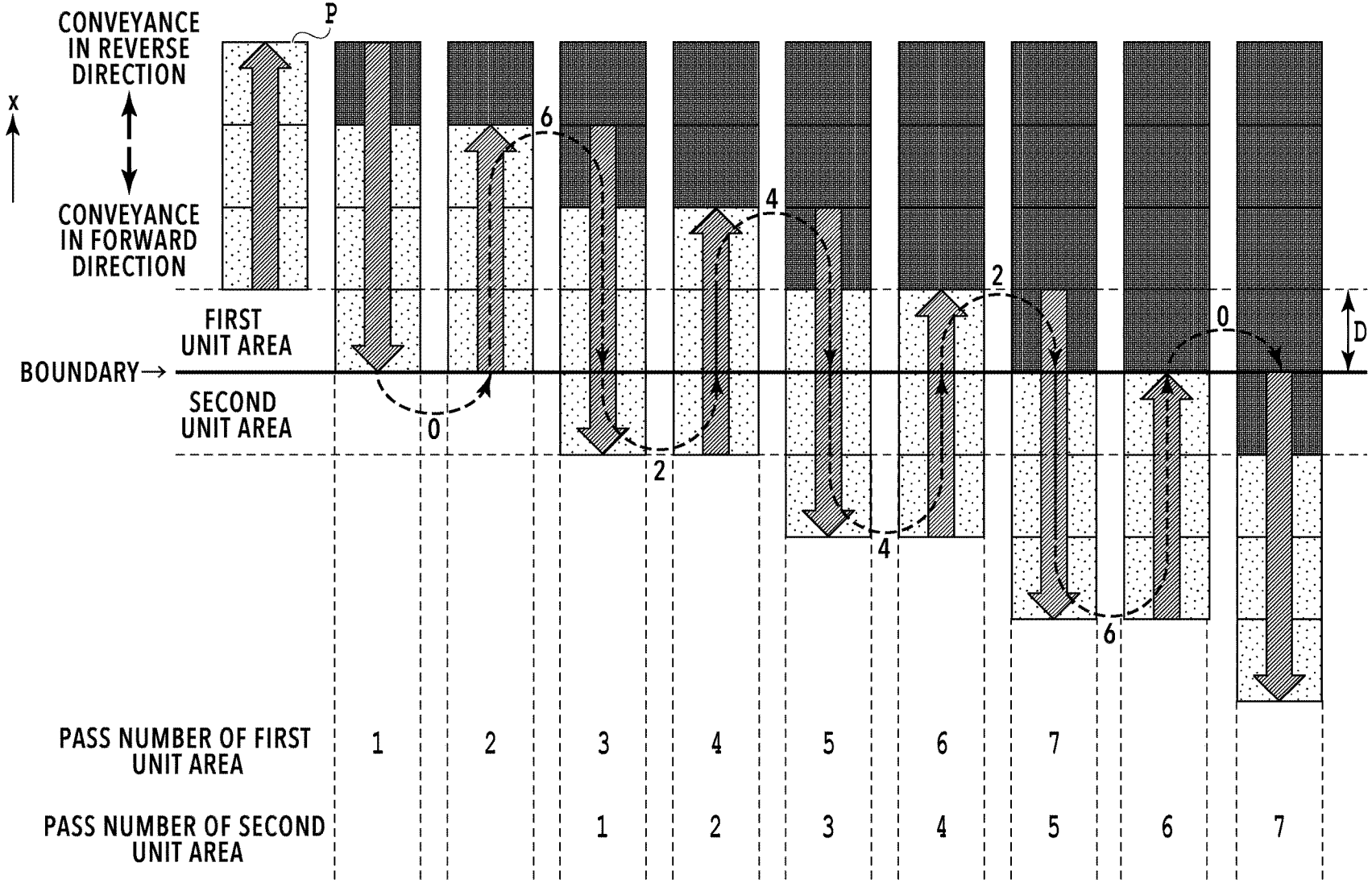
FIG. 6 is a schematic diagram for explaining multi-pass printing.

FIG. 6 is a schematic diagram for explaining multi-pass printing executed by the printing apparatus 1 according to the present embodiment. In multi-pass printing, the print medium P is conveyed in the forward and reverse directions, and an image for a unit area of the print medium P is completed stepwise by multiple relative movements during which the print heads perform ejecting operation. Hereinafter, a conveyance operation for a print medium during which the print heads perform ejecting operation as described above is referred to as a printing conveyance operation. In addition, such a printing conveyance operation during which the print medium P is conveyed in the forward direction is referred to as a forward printing conveyance operation, and a printing conveyance operation during which the print medium P is conveyed in the reverse direction is referred to as a reverse printing conveyance operation.

FIG. 6 illustrates multi-pass printing in which an image is completed in a unit area having a width of D by seven printing conveyance operations. In this figure, the above multiple printing conveyance operations are illustrated as if the print medium P were fixed, in other words, as if the print heads moved relative to a unit area. Hence, the forward direction in FIG. 6 is opposite to the substantial conveyance direction (the x direction).

In the case of seven-pass multi-pass printing, an image for each unit area is completed by four forward printing conveyance operations and three reverse printing conveyance operations performed alternately. The unit areas indicated as blank areas in FIG. 6 are unit areas for which printing has not been started. The unit areas indicated by dots indicate unit area for which printing is ongoing, and the unit areas filled in gray indicate unit area for which printing has been completed. At the bottom of the figure, pass numbers 1 to 7 are shown that indicate the number of each printing conveyance operation for both a first unit area and a second unit area that adjoin each other.

In such multi-pass printing, ink application to each unit area is divided into seven times of applications, and this prevents bleeding even in the case where a high-density image is printed on a unit area. In addition, since movement of the print head 2 in the y direction is interposed between printing conveyance operations, dots printed by each nozzle are prevented from lining in a row in the conveyance direction, and this reduces streaks and unevenness resulting from the ejection characteristics of the nozzles. Hereinafter, the seven-pass multi-pass printing described with reference to FIGS. 6 and 7 is referred to as a first printing method in the present embodiment.

In multi-pass printing, time-difference unevenness may occur because ink application timing is different between adjoining unit areas. In the following, the time-difference unevenness will be described in detail.

First, assume that T is the unit time period taken for one unit area to pass through a nozzle row. Then, pay attention to the interval between printing conveyance operations (passes) for applying ink to the first unit area. In this case, for the first unit area, 0T elapses between the first pass and the second pass, 6T between the second pass and the third pass, 2T between the third pass and the fourth pass, 4T between the fourth pass and the fifth pass, 4T between the fifth pass and the sixth pass, and 2T between the sixth pass and the seventh pass.

Next, pay attention to the interval between printing conveyance operations (passes) for applying ink to the second unit area. In this case, for the second unit area, 2T elapses between the first pass and the second pass, 4T between the second pass and the third pass, 4T between the third pass and the fourth pass, 2T between the fourth pass and the fifth pass, 6T between the fifth pass and the sixth pass, and 0T between the sixth pass and the seventh pass. The dashed line arrows in FIG. 6 schematically illustrate such elapsed time as well as the number of elapsed unit time periods T.

FIG. 7 is a diagram showing the number of elapsed unit times T (elapsed time) between the passes described above, comparing the first unit area and the second unit area. As can be clearly seen from the diagram, the number of elapsed unit times T between each pair of passes is different between the first unit area and the second unit area. This difference in elapsed time causes the difference in ink penetration and ink fixation to the print medium, and this in turn causes the difference in density, color, and gloss as an image.

Then, unit areas to which ink is applied with the same elapsed time as for the first unit area described above and unit areas to which ink is applied with the same elapsed time as for the second unit area described above are alternately positioned in the x direction in the figure. As a result, even in the case of printing a uniform image in which a similar amount of ink is applied, areas having different densities, colors, or glosses are repeatedly positioned in the x direction, and this is perceived as periodic unevenness in the entire image. Such unevenness is referred to herein as time-difference unevenness.

Figures 8A, 8B:
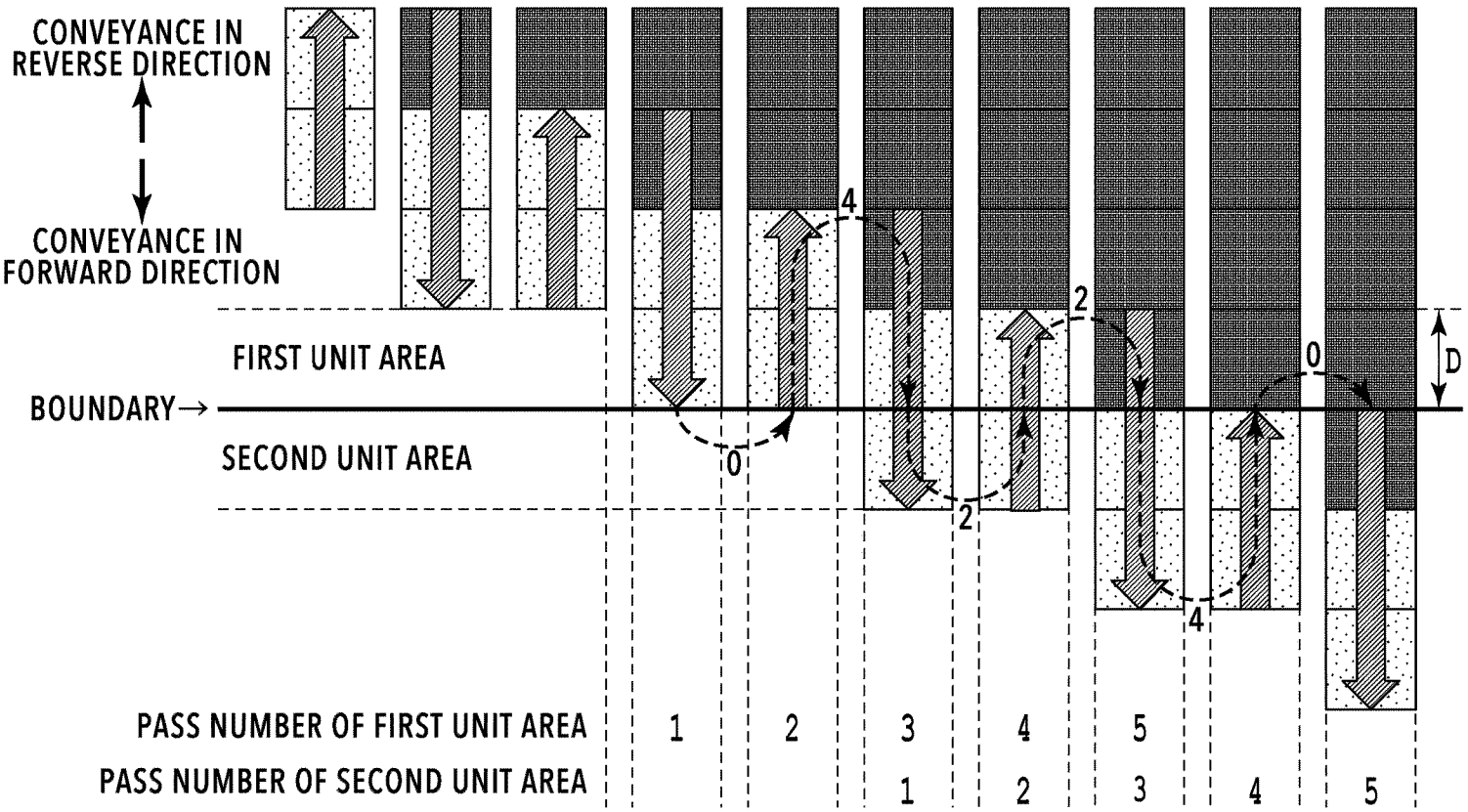
FIGS. 8A and 8B are diagrams illustrating how printing is performed and elapsed time between passes in five-pass multi-pass printing.

FIGS. 8A and 8B are diagrams for the case where the multi-pass number is five, illustrating how each unit area is printed and elapsed time between passes in the same way as in FIGS. 6 and 7. In the case of five-pass multi-pass printing, an image of each unit area is completed by three forward printing conveyance operations and tow reverse printing conveyance operations performed alternately.

For the first unit area, 0T elapses between the first pass and the second pass, 4T between the second pass and the third pass, 2T between the third pass and the fourth pass, and 2T between the fourth pass and the fifth pass. For the second unit area, 2T elapses between the first pass and the second pass, 2T between the second pass and the third pass, 4T between the third pass and the fourth pass, and 0T between the fourth pass and the fifth pass. Hereinafter, the five-pass multi-pass printing described with reference to FIGS. 8A and 8B is referred to as a second printing method.

In general, the smaller the multi-pass number is, the more noticeable the time-difference unevenness is, and the larger the multi-pass number is, the less noticeable the time-difference unevenness is. This is because the larger the multi-pass number is, the longer the time taken to apply ink, and this reduces the influence on an image that the difference in elapsed time between passes gives. In other words, if the first printing method illustrated in FIG. 6 and the second printing method illustrated in FIG. 8A are compared, time-difference unevenness is more noticeable in the five-pass multi-pass printing.

In the printing apparatus according to the present embodiment, it is assumed that time-difference unevenness is not so noticeable in the seven-pass multi-pass printing described with reference to FIG. 6 and that time-difference unevenness is noticeable in the five-pass multi-pass printing described with reference to FIGS. 8A and 8B. Based on that, a third printing method is prepared in the present embodiment in which a special conveyance method that makes time-difference unevenness less noticeable than the second printing method is executed while the five-pass multi-pass printing is performed.

Figures 9A, 9B:
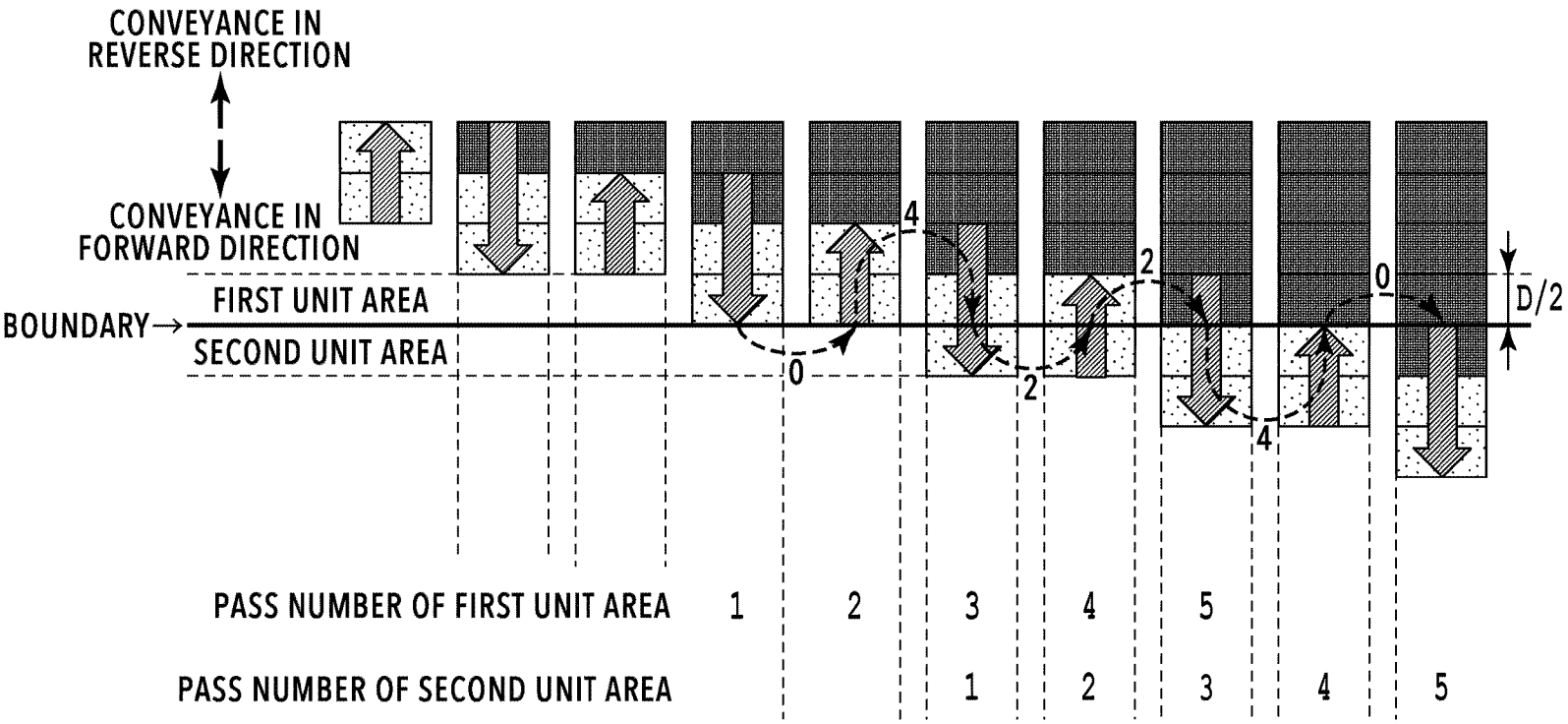
FIGS. 9A and 9B are diagrams illustrating multi-pass printing in a third printing method.

FIGS. 9A and 9B are diagrams illustrating five-pass multi-pass printing in the third printing method. As compared to FIGS. 8A and 8B, the width of the unit area is reduced to D/2. Hence, the unit time period required for one unit area to pass through a nozzle row is about half the time of the first and second printing methods, specifically, T/2.

The dashed line arrows in FIG. 9A schematically illustrate such elapsed time as well as the number of elapsed unit time periods (T/2), as in FIG. 8A. FIG. 9B shows the elapsed time between the passes. Comparing FIG. 9B with FIG. 8B, the elapsed time between the passes in the third printing method is half the elapsed time in the second printing method.

FIG. 10 is a diagram for showing the difference between the elapsed time between the passes for the first unit area and the elapsed time between the passes for the second unit area, comparing the second printing method and the third printing method. The row for the second printing method shows the values obtained by subtracting the values in the lower part of FIG. 8B (for the second unit area) from the values in the upper part (for the first unit area). The row for the third printing method, shows the values obtained by subtracting the values in the lower part of FIG. 9B (for the second unit area) from the values in the upper part (for the first unit area).

According to the diagram, the absolute value of the difference in elapsed time between the passes in the third printing method is smaller than the one in the second printing method for all pairs of passes. In other words, the third printing method makes it possible to make small the difference in elapsed time between the first unit area and the second unit area in whole. As a result, ink penetration and ink fixation to the print medium in the third printing method can be similar between unit areas compared to the second printing method, and this reduces time-difference unevenness.

As has been described above, in the present embodiment, reducing the width of unit areas makes it possible to output images with high image quality having less time-difference unevenness even though the multi-pass number is small.

Second Embodiment

How noticeable the time-difference unevenness is depends on also the type of print medium. For example, in the case where the difference in elapsed time causes the difference in gloss, time-difference unevenness is easy to perceive as an image problem on glossy print media, but it does not cause a serious problem on nonglossy print media. Time-difference unevenness is likely to cause color unevenness on coated paper having a coating layer for receiving ink or reacting with ink, but less likely on plain paper. For this reason, in the present embodiment, a different printing method is used depending on the type of print medium to be used.

FIG. 11 is a diagram showing print modes in the present embodiment. In the present embodiment, it is assumed that one print mode (printing method) is set uniquely according to the type of print medium and the print quality grade. For print medium A on which time-difference unevenness is relatively noticeable, the foregoing first printing method is used as the high-image-quality mode, and the foregoing third printing method is used as the high-speed mode. For print medium B on which time-difference unevenness is relatively less noticeable, the foregoing first printing method is used as the high-image-quality mode, and a fourth printing method is used as the high-speed mode.

The fourth printing method is five-pass multi-pass printing similar to the third printing method, but the width of the unit area is 0.8D in the fourth printing method, as compared to 0.5D of the third printing method. Hence, although the degree of time-difference unevenness is higher in the fourth printing method than in the third printing method, it is lower than in the second printing method in which the width of the unit area is D. In addition, the fourth printing method is capable of outputting images at a higher speed than in the third printing method in which the width of the unit area is 0.5D.

Thus, in the present embodiment, the unit area width in multi-pass printing is set differently depending on the type of print medium according to the degree to which time-difference unevenness is noticeable as described above. This makes it possible to output images in which time-difference unevenness is not so noticeable, at as high a speed as possible for any type of print medium.

Note that although in FIG. 11, the high-image-quality mode is the first printing method for both print medium A and print medium B, it may be different. For example, for the high-image-quality mode for print medium A on which time-difference unevenness is more noticeable, the unit area width may be further decreased compared to that in the high-image-quality mode for print medium B.

Third Embodiment

Although in the above embodiment, the width of the unit area, in other words, the conveyance length of the print medium per one printing conveyance operation is adjusted to reduce time-difference unevenness. In contrast, in the present embodiment, the conveyance speed of the print medium is adjusted to reduce time-difference unevenness.

FIG. 12 is a diagram for describing printing methods prepared in the present embodiment. Here, the characteristics of printing methods are described by the multi-pass number, the conveyance speed of the print medium, and the elapsed time between passes for adjoining unit areas. In the present embodiment, a fifth printing method is prepared in addition to the first printing method described with reference to FIG. 6. FIG. 12 also shows the second printing method described with reference to FIGS. 8A and 8B as a comparative example, in addition to the first and fifth printing methods.

In the fifth printing method, five-pass multi-pass printing described with reference to FIG. 8A is performed as in the second printing method. Here, in the fifth printing method, the conveyance speed of the print medium is set to twice that in the second printing method for each printing conveyance operation. Accordingly, the unit time period required for one unit area to pass through a nozzle row is approximately half that in the second printing method, specifically, T/2. As a result, in the fifth printing method, the difference in elapsed time between passes between the first unit area and the second unit area is approximately half that in the second printing method, in other words, approximately the same as that in the third printing method described with reference to FIG. 10. Thus, employing the fifth printing method makes it possible to reduce time-difference unevenness as the third printing method does.

Fourth Embodiment

Also in the present embodiment, a different printing method is used depending on the type of print medium to be used as in the second embodiment. In the present embodiment, a suitable printing method is prepared for each type of print medium by adjusting the multi-pass number and the conveyance speed of the print medium.

FIG. 13 is a diagram showing print modes prepared in the present embodiment. In the present embodiment, for print medium A on which time-difference unevenness is relatively noticeable, the first printing method is used as the high-image-quality mode, and the fifth printing method in which the conveyance speed is doubled is used as the high-speed mode. For print medium B on which time-difference unevenness is relatively less noticeable, the first printing method is used as the high-image-quality mode, and a sixth printing method in which the conveyance speed is increased 1.25-fold is used as the high-speed mode.

The sixth printing method is five-pass multi-pass printing similar to the second printing method described with reference to FIG. 8A, but the conveyance speed is 1.25 times that in the second printing method. Hence, although the degree of time-difference unevenness is higher in the sixth printing method than in the fifth printing method in which the conveyance speed is doubled, it is lower than in the second printing method described with reference to FIG. 8A. In addition, in the sixth printing method, bleeding is reduced according to the reduction of the conveyance speed, compared to the fifth printing method in which the conveyance speed is doubled.

In the present embodiment, the conveyance speed of the print medium in multi-pass printing is set differently depending on the type of print medium according to the degree to which time-difference unevenness is noticeable as described above. This makes it possible to output images in which time-difference unevenness is not so noticeable, at as high a speed as possible for any type of print medium.

Note that although in FIG. 13, the high-image-quality mode is the first printing method for both print medium A and print medium B, it may be different. For example, for the high-image-quality mode for print medium A on which time-difference unevenness is more noticeable, the conveyance speed of the print medium may be further increased compared to that in the high-image-quality mode for print medium B.

Other Embodiments

The first to fourth embodiments described above may be combined with one another. For example, in an embodiment, both the conveyance length (the width of the unit area) and the conveyance speed may be changed depending on the type of print medium. Specifically, in the case of multi-pass printing, problems caused by time-difference unevenness can be mitigated by adjusting conveyance conditions such as the conveyance length (the width of the unit area) and the conveyance speed to reduce the time interval between multiple printing conveyance operations performed for a unit area. In this case, the conveyance conditions may include, for example, waiting time between printing conveyance operations, acceleration time and deceleration time for conveyance, and the like.

Although in the first to fourth embodiments described above, the high-image-quality mode is seven-pass multi-pass printing, and the high-speed mode is five-pass multi-pass printing, the present invention is not limited to these configurations. A mode in which the multi-pass number is a specified number and a mode in which the multi-pass number is smaller than the specified number are only required to be prepared. Different high-image-quality modes may have different multi-pass numbers depending on the type of print medium, and the same is true of high-speed modes. Alternatively, three or more kinds of print modes may be prepared for the same type of print medium.

In addition, although in the above embodiments, the description is based on a configuration in which images are printed on a print medium held in the form of a roll as illustrated in FIGS. 1 to 3, the present invention can be applied to cut sheets.

In any way, the present invention can function effectively for printing apparatuses that print an image for each unit area of the print medium by multiple printing conveyance operations while repeating conveyance of a print medium relative to the print heads of a line type in the forward and reverse directions.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-060574 filed Mar. 27, 2019, which is hereby incorporated by reference wherein in its entirety.

What is claimed is:

1. An inkjet printing apparatus comprising:

a print head that has multiple nozzles configured to eject ink and arrayed in a first direction;

a conveying unit capable of conveying a print medium relative to the print head in a second direction intersecting the first direction and in a third direction opposite to the second direction; and a control unit configured to control the print head and the conveying unit such that an image for a unit area is printed by multiple printing conveyance operations in which a printing conveyance operation for conveying the print medium in the second direction while ejecting ink to the unit area of the print medium and a printing conveyance operation for conveying the print medium in the third direction while ejecting ink to the unit area of the print medium are repeated alternately, wherein the control unit is capable of setting a first printing method in which an image for a unit area is printed by a specified number of the printing conveyance operations and a second printing method in which an image for a unit area is printed by a smaller number than the specified number of the printing conveyance operations, and the control unit sets the first printing method and the second printing method such that a time to be taken for one printing conveyance operation of the printing conveyance operations for a unit area in the second printing method is smaller than a time to be taken for one printing conveyance operation of the printing conveyance operations for a unit area in the first printing method.

2. The inkjet printing apparatus according to claim 1, wherein the control unit makes the time to be taken for one printing conveyance operation in the second printing method shorter than the time to be taken for one printing conveyance operation in the first printing method by making a width of a unit area in a direction of the conveyance in the second printing method smaller than the width in the first printing method.

3. The inkjet printing apparatus according to claim 2, wherein the control unit sets the width differently depending on the type of print medium.

4. The inkjet printing apparatus according to claim 3, wherein the control unit sets the second printing method such that the width for a first print medium that is relatively glossy is smaller than the width for a second print medium that is relatively less glossy.

5. The inkjet printing apparatus according to claim 3, wherein the control unit sets the second printing method such that the width for a print medium with a coating layer having at least one of a function for receiving ink and a function for reacting with ink is smaller than the width for a print medium without the coating layer.

6. The inkjet printing apparatus according to claim 1, wherein the control unit makes the time to be taken for one printing conveyance operation in the second printing method shorter than the time to be taken for one printing conveyance operation in the first printing method by making conveyance speed of the printing conveyance operation in the second printing method higher than the conveyance speed in the first printing method.

7. The inkjet printing apparatus according to claim 6, wherein the control unit sets the conveyance speed differently depending on the type of print medium.

8. The inkjet printing apparatus according to claim 7, wherein the control unit sets the second printing method such that the conveyance speed of a first print medium that is relatively glossy is higher than the conveyance speed of a second print medium that is relatively less glossy.

9. The inkjet printing apparatus according to claim 7, wherein the control unit sets the second printing method such that the conveyance speed of a print medium with a coating layer having at least one of a function for receiving ink and a function for reacting with ink is higher than the conveyance speed of a print medium without the coating layer.

10. The inkjet printing apparatus according to claim 1, wherein the print head has nozzle rows each composed of multiple nozzles configured to eject ink and arrayed in the first direction, and each of the nozzle rows is associated with a different color.

11. The inkjet printing apparatus according to claim 1, wherein the print medium is a long length of a print medium held in the form of a roll.

12. An inkjet printing method for an inkjet printing apparatus including:

a print head that has multiple nozzles configured to eject ink and arrayed in a first direction; and a conveying unit capable of conveying a print medium relative to the print head in a second direction intersecting the first direction and in a third direction opposite to the second direction, wherein an image for a unit area is printed by multiple printing conveyance operations in which a printing conveyance operation for conveying the print medium in the second direction while ejecting ink to the unit area of the print medium and a printing conveyance operation for conveying the print medium in the third direction while ejecting ink to the unit area of the print medium are repeated alternately, a first printing method and a second printing method are settable; in the first printing method, an image for a unit area is printed by a specified number of the printing conveyance operations; and in the second printing method, an image for a unit area is printed by a smaller number than the specified number of the printing conveyance operations, and the first printing method and the second printing method are set such that a taken time for one printing conveyance operation of the printing conveyance operations for a unit area in the second printing method is smaller than a taken time for one printing conveyance operation of the printing conveyance operations for a unit area in the first printing method.

* * * * *